US005399068A

United States Patent [19]

Park

[11] Patent Number: 5,399,068

[45] Date of Patent: Mar. 21, 1995

[54] BLOWER SCROLL HOUSING WITH STRUCTURE TO REDUCE NOISE AND INCREASE AIR FLOW

[75] Inventor: Song I. Park, Seoul, Rep. of Korea

[73] Assignee: Goldstar Co., Ltd., Seoul, Rep. of Korea

[21] Appl. No.: 91,154

[22] Filed: Jul. 12, 1993

[30] Foreign Application Priority Data

Jul. 11, 1992 [KR] Rep. of Korea ..... 12798/1992

[51] Int. Cl.[6] ..... F04D 29/44; F04D 29/66

[52] U.S. Cl. ..... 415/204; 415/206; 415/208.3; 415/211.1; 415/211.2

[58] Field of Search ..... 415/204, 205, 206, 208.2, 415/208.3, 211.1, 211.2, 914

[56] References Cited

U.S. PATENT DOCUMENTS 4,177,005 12/1979 Bozung et al. ..... 415/151
4,381,171 4/1983 Chapple ..... 415/204
4,544,326 10/1985 Nishiguchi et al. ..... 415/204
4,795,309 1/1989 Takagi et al. ..... 415/138 X

FOREIGN PATENT DOCUMENTS 0281345 9/1988 European Pat. Off. ..... 415/136 X
523957 8/1921 France ..... 415/211.2
281958 9/1970 U.S.S.R. ..... 415/211.1 X

*Primary Examiner*—Edward K. Look
*Assistant Examiner*—Michael S. Lee
*Attorney, Agent, or Firm*—Ostrolenk, Faber, Gerb & Soffen

[57] ABSTRACT

A scroll housing structure of a multiblade blower suitable for lowering a collision noise of air and for preventing a flow loss. The structure comprises a scroll casing provided at its side wall with an air suction port, and an impeller provided in the scroll casing such that it is rotated by a rotational force of a drive source. The impeller has a plurality of blades arranged on its circumferential surface. The structure further includes an air guide unit for guiding air, expelled from the impeller, so as to prevent a streamline of the air from being curved and separated. The air guide unit extends along an upper inner surface of the scroll casing and initiates its extension from a position at which the streamline of the air expelled from the impeller is normally initially curved. Due to the air guide unit, the scroll housing structure of this invention reduces the collision noise of the air against the inner surface of the scroll casing and lowers the air flow loss.

1 Claim, 3 Drawing Sheets

BLOWER SCROLL HOUSING WITH STRUCTURE TO REDUCE NOISE AND INCREASE AIR FLOW

BACKGROUND OF THE INVENTION

1. Field of the Invention

The present invention relates in general to a scroll housing structure of a blower, and more particularly to a scroll housing structure of a multiblade blower suitable for lowering air noise and preventing flow loss.

2. Description of the Prior Art

With reference to FIGS. 1 and 2, there is shown a scroll housing structure of a multiblade blower in accordance with the prior art. The scroll housing structure includes an involute scroll casing 1 of which the upper section communicates with a delivery port 1*a* and the side wall has a suction port 1*b*. Through the suction port 1*b*, the outside air is introduced to the inside of the scroll casing 1 as will be described herein later. The scroll housing structure further includes an impeller 2 which is provided in the scroll casing 1 in such a manner that it is rotatably mounted on the center of the scroll casing 1. In order to rotate this impeller 2, an output shaft of a drive motor 2*a* is connected to the center of the impeller 2 to transmit its rotational force thereto. The impeller 2 is provided with a plurality of blades 2*b* arranged on the circumferential surface of the impeller 2.

The scroll casing 1 makes an acute angle with the delivery port 1*a* at a position where the involute of the scroll casing 1 starts. Hereinbelow, the position at which the casing 1 makes the acute angle with the delivery port 1*a* is named as an acute section 1*c*.

In operation, the impeller 2 is rotated about its center by the rotational force of the drive motor 1*a*. Such rotation of the impeller 2 generates a centrifugal force in the scroll casing 1. This forcibly introduces the outside air to the center of the impeller 2 in the scroll casing 1 through the suction port 1*b* of the casing 1. The air is in turn expelled from the rotating impeller 2 through the plurality of blades 2*b* provided on the circumferential surface of the impeller 2. The expelled air is, thereafter, delivered to the outside through the delivery port 1*a*.

In the above scroll housing structure, the pressure of the outside air, forcibly introduced to the center of the rotating impeller 2 due to the centrifugal force generated by the rotation of the impeller 2, increases while being expelled from the impeller 2 through the blades 2*b*. When the air is expelled from the impeller 2, the pressure of the air is substantially dynamic rather than static which is more desirable. In order to convert the dynamic pressure into the a static pressure, the scroll housing structure should be provided with the aforementioned involute scroll casing 1. Due to the involute scroll casing 1, the air, expelled from the rotating impeller 2 and passing by the acute section 1*c* of the casing 1 prior to flowing along the inner surface of the involute scroll casing 1, gradually recovers its static pressure while flowing along the inner surface of the involute scroll casing 1. The air recovering the static pressure is, thereafter, introduced to the delivery port 1*a* communicating with the upper section of the casing 1, and delivered to the outside or to a place requiring the air.

Turning to FIGS. 3 and 4, FIG. 3 is a speed diagram representing a flow speed of the air in the above scroll housing structure, and FIG. 4 is a sectional view of the scroll housing structure for showing the air streamlines of FIG. 3. Here, the outside air is introduced to the center of the impeller 2 in the scroll casing 1 and in turn pressurized by the centrifugal force generated by the rotation of the impeller 2, and flows along the inner surface of the scroll casing 1, as described above. When the air flows along the inner surface of the scroll casing 1, it forms streamlines as shown in FIGS. 3 and 4. In the FIG. 3, a flow speed of an air streamline is shown in a speed diagram at every predetermined point on the inner surface of the involute scroll casing 1. In FIG. 4, there are shown first and second streamlines A and B of the air expelled from the impeller 2 through the blades 2*b* as well as curvatures of the first and second streamlines A and B.

As shown in FIGS. 3 and 4, the streamline curvature of the outside air, forcibly introduced to the center of the rotating impeller 2 is increased due to the centrifugal force while passing through the blades 2*b*. Hence, the air undesirably flows along separated streamlines. That is, besides the first streamline A the air forms a second streamline B which is undesirably formed at a section near the suction port 1*b*, thus causing a flow loss. Moreover, the first streamline A or the primary streamline is curved to the side wall, on which the suction port 1*b*, is provided, thereby making the flow loss be worse.

The aforementioned problem starts to be prominently observed at a position corresponding to a line D ($\Theta=270°$) which is angularly spaced apart from a predetermined reference line C ($\Theta=0°$) of the scroll casing 1 by a predetermined angle.

In addition, the aforementioned increasing curvatures of the first and second streamlines A and B intensify the collision of the air against the inner surface of the scroll casing 1, thereby increasing the collision noise of the air. Another problem of the known scroll housing structure is resided in that the effective sectional area of the delivery port 1*a* of the scroll casing 1 is reduced and, as a result, a desired smooth recovery of the static pressure of the air is difficult to be achieved.

SUMMARY OF THE INVENTION

It is, therefore, an object of the present invention to provide a scroll housing structure of a blower in which the aforementioned problems can be overcome by lowering the collision noise caused by the collision of the air against the inner surface of a scroll casing and preventing the flow loss caused by both the separation of a streamline of the air in the scroll casing and the curving of the air streamline.

To accomplish the above object, a scroll housing structure in accordance with a preferred embodiment of the present invention comprises a scroll casing provided at its side wall with an air suction port; an impeller provided in the scroll casing such that it is rotated by a rotational force of a drive source, the impeller having a plurality of blades arranged on its circumferential surface; and an air guide unit for guiding air, expelled from the impeller, so as to prevent a streamline of the air from being curved and separated, the guide unit extending along an upper inner surface of the scroll casing and initiating its extension from a position at which the streamline of the air expelled from the impeller intends to be initially curved and separated.

In accordance with the scroll housing structure of the present invention, the impeller is rotated by the rotational force of the drive source and this generates a centrifugal force causing the outside air to be forcibly introduced to the impeller and to be expelled from the impeller through the plurality of blades while being pressurized. At an acute section of the scroll casing, the expelled air starts its flow along the inner surface of the scroll casing and is finally introduced to the delivery port, communicating with the upper section of the casing, under the guide of the air guide unit.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENT

Figure 1:
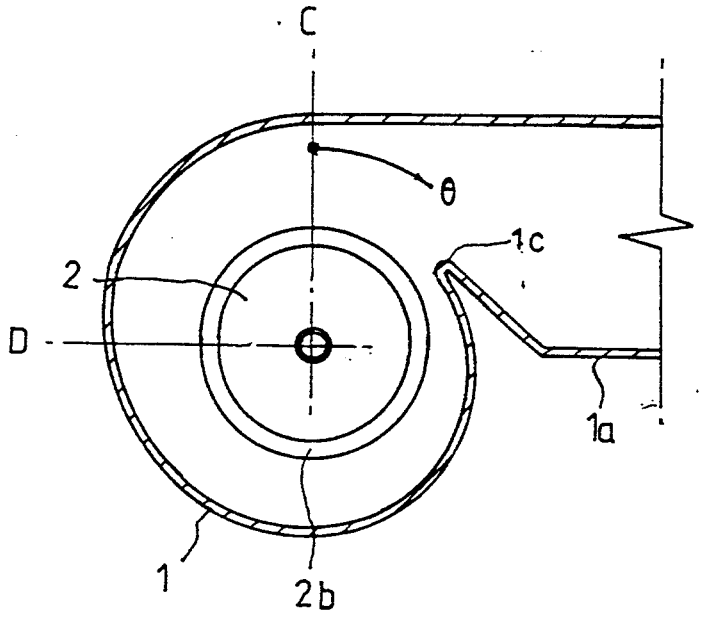
FIG.1 PRIOR ART
FIG. 1 is a vertical sectional view of a scroll housing structure of a multiblade blower in accordance with the prior art.
Figure 2:
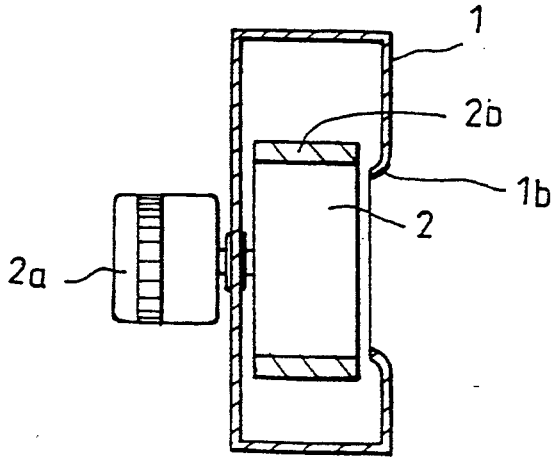
FIG.2 PRIOR ART
FIG. 2 is a transverse sectional view of the scroll housing structure of FIG. 1.
Figure 3:
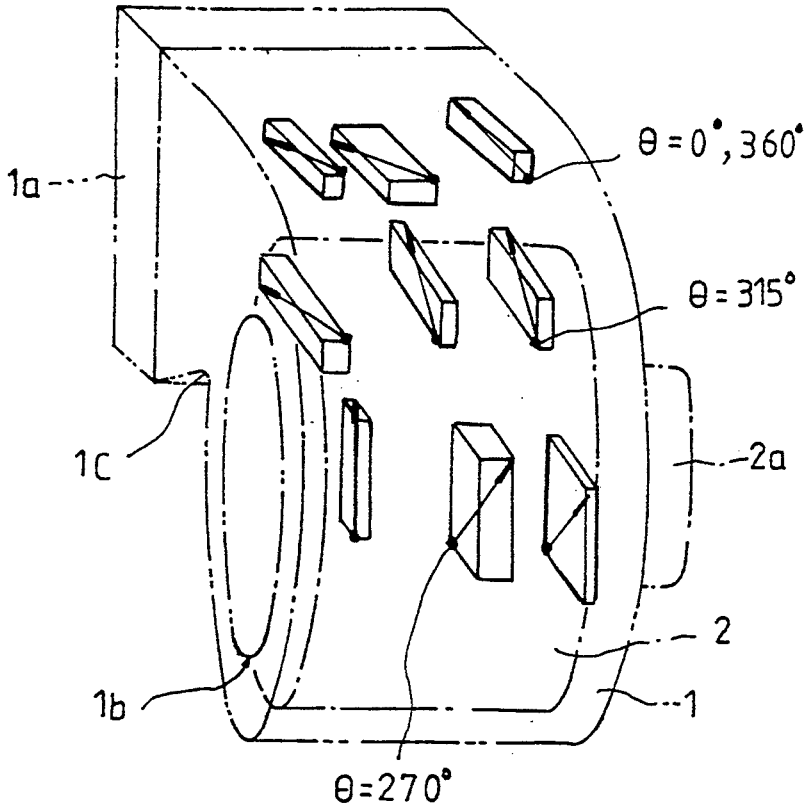
FIG. 3 is a speed diagram representing a flow speed of the air in the scroll housing structure of FIG. 1.
Figure 4:
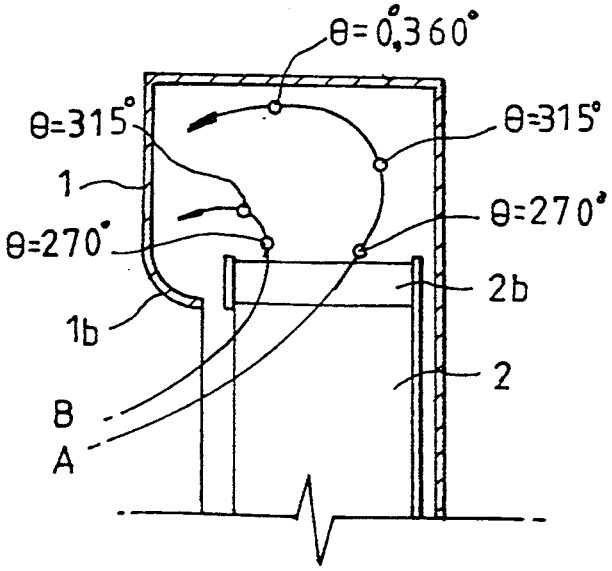
FIG. 4 is a sectional view of the scroll housing structure for showing the air streamlines of FIG. 3.
Figure 5:
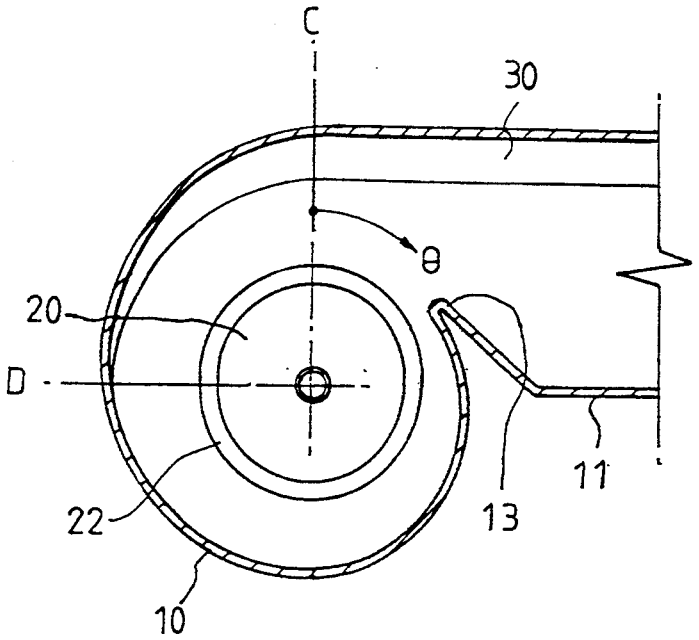
FIG. 5 is a vertical sectional view of a scroll housing structure of a multiblade blower in accordance with a preferred embodiment of the present invention.
Figure 6:
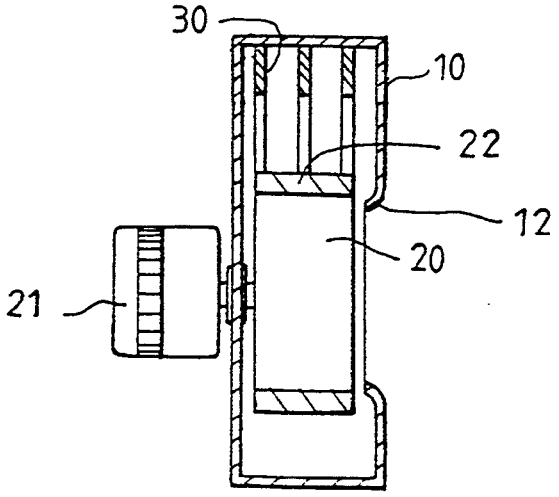
FIG. 6 is a transverse sectional view of the scroll housing structure of FIG. 5.

With reference to FIGS. 5 and 6, there is shown a scroll housing structure of a multiblade blower in accordance with a preferred embodiment of the present invention. The scroll housing structure includes an involute scroll casing 10 which communicates with a delivery port 11 at its upper section. The scroll casing 10 is provided at its side wall with a suction port 12 which guides the outside air forcibly to the inside of the scroll casing 10. The scroll housing structure also includes an impeller 20 which is provided in the scroll casing 10 in such a manner that it is rotatably mounted on the center of the scroll casing 10. The center of the impeller 20 is connected to an output shaft of a drive motor 21 and applied with the rotational force of the drive motor 21. A plurality of blades 22 are arranged on the circumferential surface of the impeller 20, spaced at predetermined intervals. The scroll housing structure further includes an air guide unit or means 30 which extends along an upper inner surface of the scroll casing 10 and guides the air expelled from the rotating impeller 20 so as to introduce the air to the delivery port 11.

At an acute section 13 where the involute of the scroll casing 10 starts, the scroll casing 10 makes an acute angle with the delivery port 1*a*.

The air guide unit 30 comprises a plurality of spaced vertical plates which longitudinally extend along the upper inner surface of the scroll casing 10 while being spaced apart from each other. The guide sheet unit 30 initially extends from a position corresponding to the D line ($\Theta=270°$) at which the air, expelled from the impeller 20 through the blades 22, is likely to be separated and to form the first and second streamlines A and B.

In operation, the impeller 20 in the scroll casing 10 is rotated about its center by the rotational force of the drive motor 21. Such a rotation of the impeller 20 generates a centrifugal force in the scroll casing 10, and this causes the outside air to be forcibly introduced to the center of the impeller 20 through the suction port 12 of the casing 10. The air is in turn expelled from the rotating impeller 20 through the plurality of blades 22 provided on the circumferential surface of the impeller 20. At the acute section 13 of the scroll casing 10, the expelled air starts its flow along the inner surface of the scroll casing 10 and is finally introduced to the delivery port 11, communicating with the upper section of the casing 10, guided by the air guide unit 30.

When the air reaches the position corresponding to the D line ($\Theta=270°$), at which the air streamline is likely to be initially separated and prominently curved, during its flow along the inner surface of the scroll casing 10, the air streamline is initially guided by the spaced vertical plates of the guide sheet unit 30, so that it is prevented from being curved to the side wall of the scroll casing 10.

In the present invention, the scroll casing 10 is provided with the air guide unit 30 comprising the plurality of spaced vertical plates longitudinally extending along the upper inner surface of the scroll casing 10. Particularly, the guide sheet unit 30 initiates its extension at the position corresponding to the D line ($\Theta=270°$) at which the air, expelled from the impeller 20 through the blades 22, is normally separated from its streamline and exhibits the prominent curving of its streamline. The scroll housing structure of this invention thus causes the air, expelled from the impeller 20, to be guided by the guide sheet unit 30 to the delivery port 11. Therefore, the present invention prevents the air streamline from being curved to the side wall of the scroll casing 10 as well as from being separated, thus reducing the noise of the air colliding against the inner surface of the scroll casing 10, lowering the flow loss.

As described above, the scroll housing structure of a blower in accordance with present invention is provided with an air guide unit on the inner surface of a scroll casing for guiding the air, expelled from an impeller, and for introducing the air to the delivery port, thus reducing the collision noise of the air against the inner surface of the scroll casing and lowering the air flow loss.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A scroll housing structure of a blower comprising:

a scroll casing having a side wall with an air suction port at said side wall and including an air output port;

a rotatable impeller provided in said scroll casing, said impeller having a plurality of blades on its circumferential surface, said casing further having a peripheral wall extending substantially circumferentially around said impeller, said peripheral wall having an interior surface facing said impeller, said impeller defining around itself a circumferential region circumscribing an angular range from 0° to 360°; and air guide means for guiding air, expelled from said impeller, so as to prevent a streamline of said air from curving and separating and flowing toward said side wall of said casing, said air guide means extending from and along an upper portion of said inner surface of said scroll casing from a position at which said streamline of the air expelled from said impeller begins to be initially curved and separated to a position adjacent said output port, said air guide means being so formed that it begins at an angle of about 270° and continues to extend to at least an angle of 360° of said angular range associated with said impeller and including a plurality of parallel spaced elements extending from and along the upper portion of said inner surface of said scroll casing.

* * * * *